United States Patent [19]

Nymoen

[11] 4,185,565

[45] Jan. 29, 1980

[54] CORRUGATED PALLET

[75] Inventor: John A. Nymoen, Robbinsdale, Minn.

[73] Assignee: Liberty Carton Co., Minneapolis, Minn.

[21] Appl. No.: 942,194

[22] Filed: Sep. 14, 1978

[51] Int. Cl.[2] ..... B65D 19/34

[52] U.S. Cl. ..... 108/51.3; 108/56.1

[58] Field of Search ..... 108/51.3, 56.1, 51.1, 108/57.1, 51.5, 55.1; 229/23 AB; 248/152, 174, 346; 206/386, 599, 600; 214/10.5 R; 5/DIG. 1

[56] References Cited

U.S. PATENT DOCUMENTS

| | | | |
|---|---|---|---|
| 2,479,728 | 8/1949 | Darling | 108/51.3 |
| 2,928,638 | 3/1960 | Parker | 108/51.3 |
| 3,006,590 | 10/1961 | Hoag | 108/51.3 |
| 3,246,824 | 4/1966 | Gardner | 108/51.3 X |
| 3,302,593 | 2/1967 | Roberts | 108/51.3 |
| 3,911,834 | 10/1975 | Quaintance | 108/57.1 X |

FOREIGN PATENT DOCUMENTS

| | | | |
|---|---|---|---|
| 216452 | 10/1967 | Sweden | 108/51.3 |

*Primary Examiner*—William E. Lyddane

*Attorney, Agent, or Firm*—Williamson, Bains, Moore & Hansen

[57] ABSTRACT

A pallet is formed by folding and gluing two pieces of corrugated board. A first or base piece is formed of three parallel spaced channel sections connected by platform reinforcing portions. A second or platform piece is formed mainly of a platform resting upon the platform reinforcing portions of the first piece and has flaps depending perpendicularly downwardly into each end of each of the channel sections. Tabs hinge outwardly from the flaps and are secured to the sides of each of the channel members by gluing.

5 Claims, 3 Drawing Figures

CORRUGATED PALLET

BACKGROUND OF THE INVENTION

The use of pallets for storage and transport of various sorts of goods is well-known. Traditionally, these pallets have been made of wood, requiring the nailing together of several pieces. Such pallets have tended to be relatively expensive both in terms of materials and the amount of labor required to assemble such devices. More recently, it has been proposed to make pallets out of corrugated board in order to provide a much more inexpensive device which, while not as long lived, will more than adequately perform on a short term basis. Such folding pallets are perhaps typified by U.S. Pat. Nos. 3,911,834; 3,007,663; 2,696,356; 2,928,638 and 3,006,590. Such prior art devices are generally deficient in that they are either overly complex and therefore expensive to manufacture, or alternatively are not strong enough to withstand the sizable loads imposed on such pallets.

It is therefore an object of this invention to provide a pallet formed of corrugated board which may be folded and glued into the desired configuration which will be simple and inexpensive to manufacture as well as being of a strength sufficient to withstand normal use for the desired life of the device. It is further an object of this invention to provide a folding pallet which may be easily assembled from its component parts at the job site if it is desired to ship such pallet in a collapsed configuration.

SUMMARY OF THE INVENTION

The pallet of the instant invention is comprised of two pieces: a first or base piece and a second or platform piece. The base piece is formed from a rectangular sheet of corrugated board having a plurality of parallel fold lines located thereon. The fold lines serve to form three parallel spaced channel members connected by raised platform reinforcing portions. The platform piece is provided with a number of locating and reinforcing side flaps positioned so as to be located adjacent each end of each of the channels of the base piece. The platform piece overlies the platform reinforcing portions of the base piece and the aforementioned flaps fold downwardly into each of the channels. Each flap further has three tabs hinged at the three sides of the flap opposite the platform, and these tabs are folded perpendicular to the flaps and glued to the respective side and bottom walls of the channel. Further, end flaps are located at either end of the platform member and are hinged downwardly to adhesively mate with the outside wall of the channel at each end.

These and other objects and advantages of this invention will more fully appear from the foregoing description made in connection with the accompanying drawings, wherein like reference characters refer to the same or similar parts throughout the several views.

DESCRIPTION OF THE DRAWING FIGURES

DESCRIPTION OF THE PREFERRED EMBODIMENT

Figure 1:
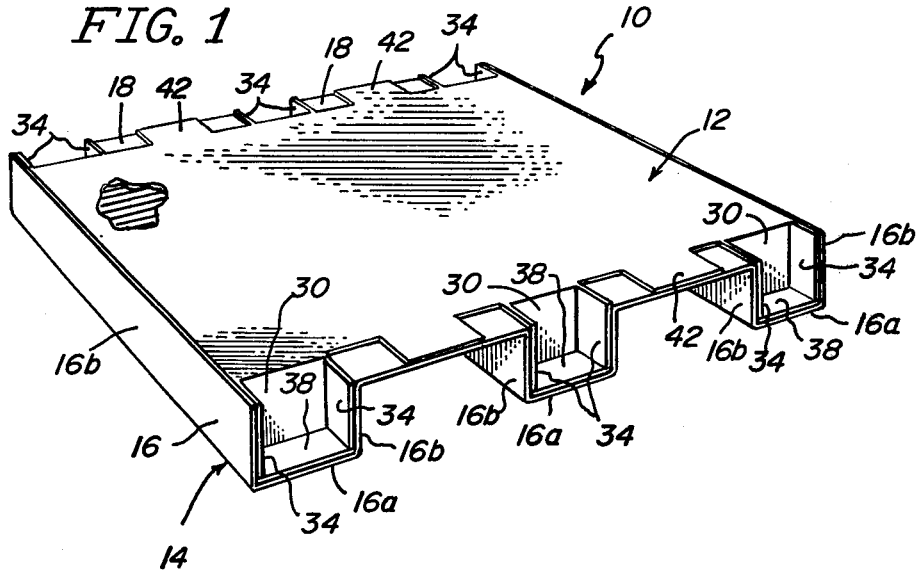
FIG. 1 is a perspective view of the assembled pallet.
Figure 2:
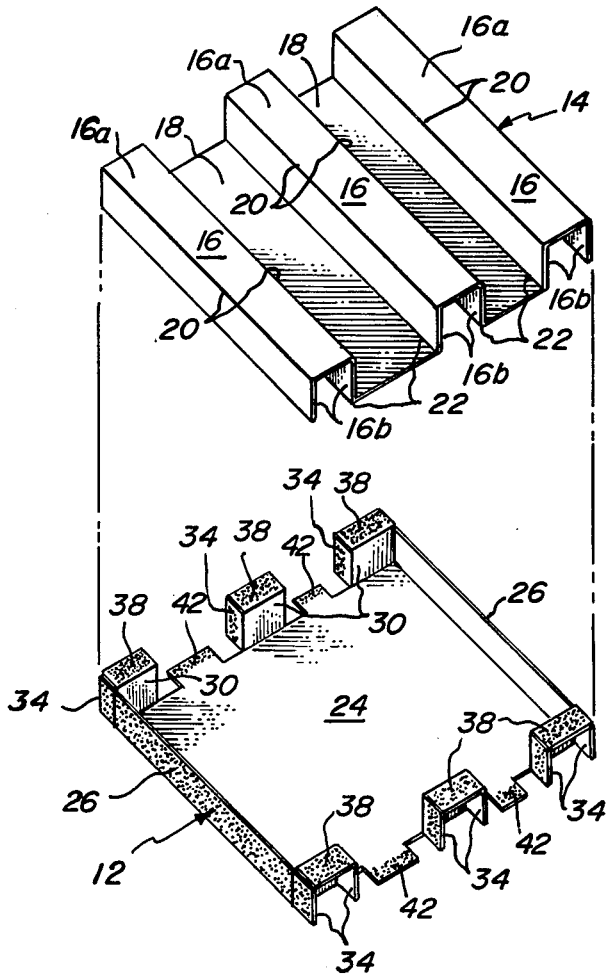
FIG. 2 is an exploded view of the pallet in an inverted position.

Referring now to the drawings, FIG. 1 shows the pallet in position to be used. FIG. 2 shows the pallet assembly exploded and inverted in order to aid in understanding of the construction. The pallet, generally 10, is formed of a first or base piece 14 and a second or platform piece 12. Base 14 is shown best in FIG. 2 and consists of three channel members 16 separated by two platform reinforcing panels 18. Each channel 16 is comprised of channel bottom **16*a* connected at fold lines 20 to channel side walls 16*b*. Reinforcing panels 18 are foldably connected to channel side walls 16*b* at fold lines 22. Thus, base piece 14 is easily and expeditiously formed from a simple rectangular piece of corrugated board by means of a plurality of parallel score or fold lines. Desirably, the corrugation of the material used to form base 14 runs perpendicular to the longitudinal extent of channel 16**.

Figure 3:
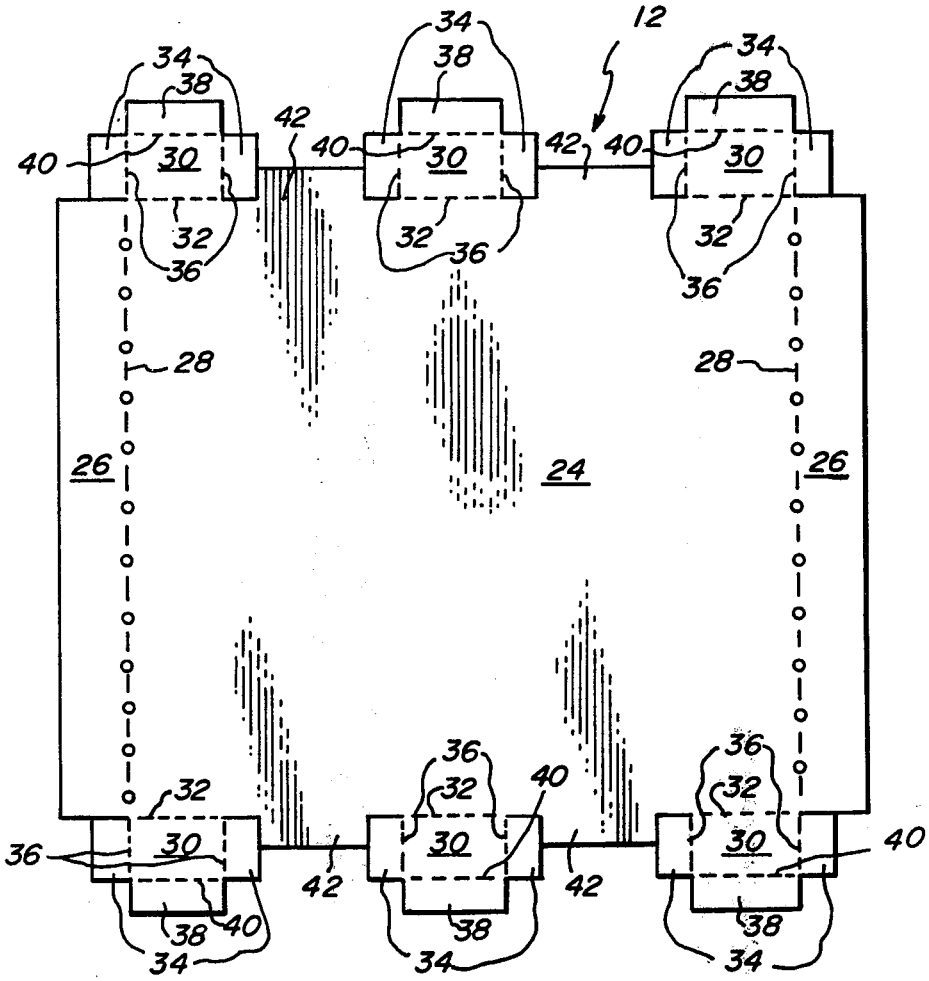
FIG. 3 shows the blank for the platform piece of the pallet.

The construction of the blank used to form platform piece 12 is best shown in FIG. 3. Platform piece 12 is formed from a generally rectangular piece of corrugated board and comprises a central platform panel 24 having hinged at either end thereof end flaps 26 by means of fold lines 28. The width of end flaps 26 are substantially equal to the height of channel side walls **16*b* as can be appreciated by viewing FIG. 1. A plurality of side flaps 30 are hingedly attached to fold lines 32 to platform panel 24. Side flaps 30 are spaced along either side of platform panel 24, the spacing corresponding to the spacing of channels 16 of base 14. Side tabs 34 are attached at fold lines 36 on opposite sides of side flaps 30. Bottom tab 38 is hingedly attached to side flap 30 at fold line 40. The width of side flap 30 (between fold lines 36) is equal to the width of channel bottom 16*a* while the height of side flap 30 is equivalent to the height of channel side 16*b*. Glue tabs 42 extend outwardly from platform panel 24 and serve to space apart side flaps 30 as well as aiding in securing platform 24 to platform reinforcing panels 18. The corrugation of platform 12 runs from end to end, that is, the corrugation is parallel to fold lines 32 as shown in FIG. 3**.

Assembly takes place as indicated in FIG. 2. First, side flaps 30 are folded upwardly until perpendicular to platform panel 24. Then, side tabs 34 and bottom tabs 38 are folded outwardly so as to be perpendicular to side flaps 30. Similarly, end flaps 26 are folded upwardly, also perpendicular to platform panel 24. At this point adhesive is applied as shown in the shaded areas of FIG. 2. Base 14 is formed by bending the corrugated board to form the shape shown in the upper half of FIG. 2. Then, the two pieces are brought vertically together to form the finished device shown in FIG. 1 which of course is inverted from the orientation shown in FIG. 2.

While the preferred embodiments of the present invention have been described, it should be understood that various changes, adaptations and modifications may be made therein without departing from the spirit of the invention and the scope of the appended claims.

What is claimed is:

1. A pallet which comprises:

a base constructed of a piece of sheet material which comprises:

a plurality of spaced, parallel, upwardly opening channel members, each of said channel members having a bottom and two sides, each side having a top longitudinal edge, at least one platform reinforcing portion extending between the top longitudinal edges of facing sides of adjacent channel members, whereby adjacent ones of said channel members are foldably connected and spaced apart at said top longitudinal edges by a reinforcing portion, a platform piece constructed of a substantially rectangular piece of sheet material comprising:

a platform panel having first and second sides and first and second ends, said platform panel overlying said base with said platform panel ends being parallel to said top longitudinal edges and said platform panel bearing on said platform reinforcing portion, a plurality of side flaps hingedly attached to said platform sides and extending downwardly into said channel members, means fastening said side flaps to said channel members said fastening means comprises at least one tab foldably attached to each of said side flaps and secured to a respective channel member.

2. The pallet of claim 1 wherein said side flaps are sized and shaped to conform to the cross section of said channel members.

3. The pallet of claim 2 wherein said tab is a bottom tab attached to each of said side flaps at the edge opposite said platform panel, said bottom tabs attached to said channel bottom.

4. The pallet of claim 3 further comprising two side tabs hinged to opposite edges of each said side flap, said side tabs being attached to adjacent channel side walls.

5. The pallet of claim 4 further comprising first and second end flaps hinged to said first and second ends respectively, said end flaps being secured to adjacent channel member sides.

* * * * *